United States Patent [19]

Woronets

[11] 4,392,325

[45] Jul. 12, 1983

[54] SPORTS WHISTLE WITH FINGER GRIP

[76] Inventor: Eli M. Woronets, 14413 Mansa Dr., La Mirada, Calif. 90638

[21] Appl. No.: 302,982

[22] Filed: Sep. 17, 1981

[51] Int. Cl.[3] ..... A63H 5/00

[52] U.S. Cl. ..... 46/179; 46/178

[58] Field of Search ..... 46/179, 178, 175 R, 46/180, 181, 175 AR, 193, 191, 61; 244/155 R, 155 A; 273/54

[56] References Cited

U.S. PATENT DOCUMENTS

| | | | |
|---|---|---|---|
| 589,582 | 12/1959 | Scron | 46/179 |
| 1,688,348 | 10/1928 | Petric | 46/179 |
| 1,688,349 | 10/1928 | Petric | 46/179 |
| 3,120,213 | 4/1964 | Mulligan | 46/179 |
| 3,421,761 | 1/1969 | Grant | 273/54 |

*Primary Examiner*—Robert A. Hafer
*Assistant Examiner*—J. Weiss
*Attorney, Agent, or Firm*—Ben E. Lofstedt

[57] ABSTRACT

A mouth-blown sports' whistle with a resiliently compliant ring of material surrounding the end of the whistle for engagement with the operator's mouth to prevent injury to the whistle user's teeth and having a whistle body with a C-shaped member forming a finger-gripping arrangement therewith and depending therefrom, the C-shaped members being bridged by a length of tubing formed of an elastomeric substance having a memory slipped over the ends of the C-shaped member, the tubing forming a substantially improved finger gripping and cushioning arrangement with the C-shaped member.

7 Claims, 3 Drawing Figures

SPORTS WHISTLE WITH FINGER GRIP

BACKGROUND OF THE INVENTION

1. Field of the Invention

The present invention relates to sports' whistles, and, more particularly, to hockey referee whistles which are gripped by the fingers of the referee's hand and operated by inserting it into the referee's mouth and blowing into it.

2. Description of the Prior Art

In playing the game of hockey, football, basketball, and various other multiple person sports' games and activities, a mouth-blown whistle is employed by the games referees to rapidly communicate with the game's players to signal the end of play or the resumption of activities or the like. Such is necessary for control of the game by referees.

A whistle simply held by the fingers of the hand and tied to a loop of flexible material and placed about the neck of the referee has been frequently recognized in the prior art as inadequate due to the substantial amount of time it takes for the referee to decide to act, locate the whistle, to grab it with his hand, to insert it into his mouth and to blow it.

As a consequence, a whistle was designed having a C-shaped element secured to the underside of the whistle body forming a gripping surface about a pair of the referee's fingers. Such an arrangement offers a vast improvement of the speed of the referee's response to the game's activities.

However, one of the problems discovered in use of this type of a whistle is the real risk and danger of the referee chipping or otherwise causing injury to his teeth by the rapid insertion of the mouth blowing end of the whistle into his mouth, thereby placing the whistle into proper position for operation.

Another equally important problem with this prior art whistle is that the finger-gripping element goughed the fingers in a not-so-kindly fashion, producing calloused, and, sometimes, cut fingers.

The present improved and unique whistle was created to solve and over come the hereinbefore mentioned problems of the prior art whistles.

SUMMARY OF THE INVENTION AND OBJECTS

Fundamentally, the instant invention comprises a mouth-blown whistle having a ring of resilient material surrounding the mouth-engaging end of the whistle in order to prevent injury to the whistle user's teeth, a C-shaped member secured to the bottom of the body of the whistle to form a finger-gripping arrangement with the whistle, the open ends of the C-shaped members being bridged by a length of tubing formed of an elastomeric substance having a memory slipped over the ends, whereby the tubing forms a significantly improved finger gripping and cushioning arrangement with the C-shaped member.

It is an important and significant object of the present invention to provide a sport's whistle with a teeth cushioning element about the end of the whistle which engages the mouth of the user in order that the whistle might be blown.

Another primary and important object of the present invention is to provide a sport's whistle having a C-shaped finger-gripping element secured thereto with a length of elastomeric tubing with memory slipped over the ends of the C-shaped member to form an improved finger gripping and cushioning arrangement with the C-shaped member.

A yet still further and primary object of the instant invention is to provide a sport's whistle with a means to provent cutting of the fingers in spite of the need to rapidly respond to the game's activities.

The invention will be better understood and objects other than those set forth above, will become apparent, when consideration is given to the following detailed description thereof. Such description makes reference to the annexed drawings wherein:

DESCRIPTION OF THE PREFERRED EMBODIMENT

Figure 1:
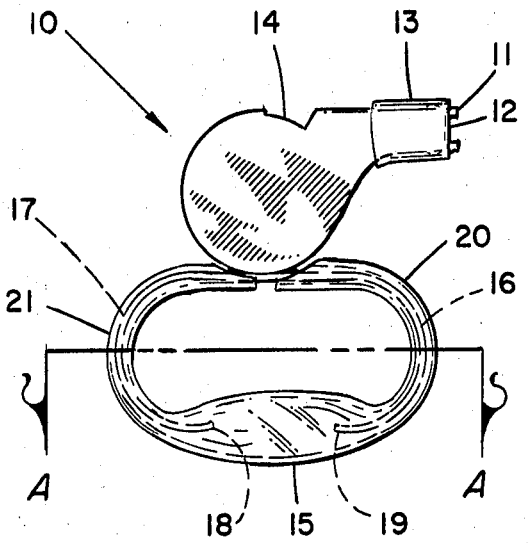
FIG. 1 is a side elevational view of the present invention.
Figure 2:
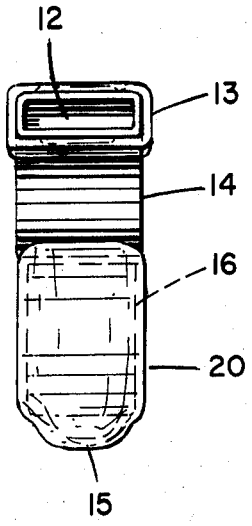
FIG. 2 is a front vertical elevational view of the instant invention.
Figure 3:
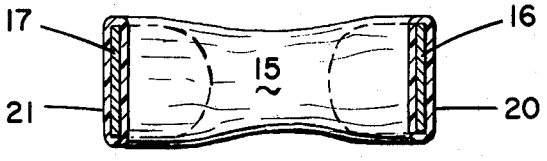
FIG. 3 is a bottom view of the present invention.

With continued reference now to the drawings herein, there is generally shown the present invention at 10, more particularly referred to as a sports' whistle with finger grip. The whistle 10 comprises, basically, a body 11 having an air inlet 12, an air plenum within the body 11, an air outlet 14, and a C-shaped finger grip formed with two arms 16 and 17.

A relatively resilient material such as an elastomeric substance, such as rubber soft plastic, or the like, forms a ring 13 about the air inlet 12. The purpose of this ring 13 will become clear as the description proceeds herein afterwards.

A length of tubing formed of a resilient material, such as plastic or other elastomeric substance having a memory, is preferrably employed to form coverings 20, 21 over the two arms 16 and 17, after being passed over the open ends 18 and 19 of said arms 16, 17. Further, by so doing, the tubing forms a bridge 15 between the two open ends 18 and 19. The purpose of this bridge 15 will become more clearly understood as the description of the invention proceeds further hereinafterwards.

Operation of the whistle 11 is relatively simple. The referee simply places the whistle 11 over the forefinger and the middle finger by engaging the finger grip formed by the two arms 16 and 17. The plastic tubing which forms coverings 20 an 21 over the arms 16 and 17 and the bridge 15 bridging the gap between the open ends 18 and 19 of the arms 16 and 17 act to resiliently grip and engage the fingers and to act as a cushion between the typically metal body of the whistle 11 and the fingers of the referee.

Additionally, the use of a plastic or elastomeric substance with a memory to form the tubing which forms the coverings 20 and 21 and the bridge 15 causes the bridge 15 to assume an inflated-looking contour and shape. This shape improves the grip and holding characteristic of the whistle 11 with the referee's fingers. This positive gripping action, along with the protection it provides by acting to cushion the whistle 11 against the referee's fingers, is extremely important.

Consider, for a moment, the fast play action of hockey, football, or basketball and the movement of the referee about the various plays set up by the game players. The referee must react extremely quick to stop the play by blowing his whistle 11. If the gripping action between the fingers and the whistle 11 was less than positive, the whistle 11 would be easily thrown from the referee's hand. This, of course, is totally unacceptable from a referee's standpoint.

When the referee acts to stop the play or to initiate play again, he draws the whistle 11 up and inserts the air inlet 12 of the whistle 11 into his mouth. This frequently occurs very rapidly in reaction to the activities engaged in by the players. Because the "official" whistles 11 are constructed by metal, the rapid engagement of the air inlet 12 end of the whistle 11 with the referee's mouth could easily result in a chipped tooth or two. In order to resolve this problem, a ring 13 of resilient material is placed about the air inlet 12 to preclude this injury from occurring.

The overall result of this substantially improved sports' whistle 11 construction is a safe and more easily useable sports' whistle 11 which is highly preferred by referees.

While I have shown and described a preferred embodiment in accordance with the present invention, it is understood that the same is not limited thereto but is susceptible of numerous changes and modifications within the spirit and scope thereof and I therefore do not wish to be limited to the details shown and described herein but intend to cover all such changes and modifications as are encompassed by the scope of the appended claims. For example, in order to substantially improve the acoustical loudness of the whistle and its tone, a small ball (not shown) made of a light-weight material, such as cork, and having a diameter of not greater than seventy-five percent of the diameter of the body 11 is placed within the body 11. When blown, the air flow causes the ball to be moved across the air outlet 14. As it moves across the air outlet 14, it alternately closes and opens the air outlet 14 thereby causing a tonal change to take place and producing a substantial acoustical output.

I claim:

1. An improved, mouth-blown whistle, comprising:

(a) a hollow body having an air inlet and an air outlet;

(b) cushioning means disposed peripherially about the outside of said air inlet to prevent chipping of the user's teeth as the air inlet end of the whistle is inserted into the user's mouth to blow said whistle and even while the whistle is being blown;

(c) a C-shaped finger gripping member secured to the underside of said body; and (d) resilient covering means over said finger gripping member and bridging the opening between the open ends of said C-shaped member, said portion of said resilient covering means bridging the space bulbously enlarged to fill the empty space between the two fingers which engage the finger gripping member thereby creating a frictional gripping action between said resilient covering means and the two fingers inserted therein to hold the whistle.

2. The whistle of claim 1, wherein said hollow body comprises:

(a) a first tubular body, the ends of said tubular body being capped in order to close both ends of said tubular body thereby forming an air plenum therein, said tubular body having a pair of openings into the body of said tubular body, said openings disposed in spaced-apart relationship, one of said openings being an air inlet to said tubular body and the other of said openings being an air outlet to said tubular body; and (b) a second tubular body having a pair of open ends therein, one of said open ends disposed about the air inlet opening into said first tubular body and operably secured to the tubular body about said air inlet opening, thereby forming an air inlet channel insertable into the mouth of a human whereby the lips and and teeth of the mouth can grip the second tubular body for blowing air thereinto.

3. The whistle of claim 1, wherein said cushioning means is an elastomeric substance forming the surface about the outside of said air inlet.

4. The whistle of claim 3, wherein said elastomeric substance is plastic.

5. The whistle of claim 1 further having a ball freely moveable therein, said ball having a diameter of not greater than seventy-five percent of the inner diameter of the hollow body, said ball serving to act as an air valving element alternatively opening and closing a substantial portion of the air outlet of said hollow body thereby increasing the the sound which eminates from the whistle when blown.

6. The whistle of claim 1 wherein said resilient covering mean over said finger gripping member and bridging the opening between the open ends of said C-shaped member is formed of an elastomeric substance.

7. The whistle of claim 6 wherein said elastomeric substance is plastic.

* * * * *